United States Patent [19]

Kranefeld et al.

[11] 4,100,707

[45] Jul. 18, 1978

[54] TELESCOPIC BOOM FOR PORTABLE CRANES

[75] Inventors: Wilhelm Kranefeld, Wetter; Helmut Schneider, Kamen-Methler, both of Fed. Rep. of Germany

[73] Assignee: O & K Orenstein & Koppel Aktiengesellschaft, Berlin, Fed. Rep. of Germany

[21] Appl. No.: 827,306

[22] Filed: Aug. 24, 1977

[30] Foreign Application Priority Data

Aug. 25, 1976 [DE] Fed. Rep. of Germany ..... 2638185

[51] Int. Cl.[2] ..... B66C 23/04

[52] U.S. Cl. ..... 52/115; 52/118; 212/55; 212/144; 254/108

[58] Field of Search ..... 212/55, 144; 52/115, 52/118; 254/108

[56] References Cited

U.S. PATENT DOCUMENTS

| | | | |
|---|---|---|---|
| 3,795,321 | 3/1974 | Johnston | 212/55 |
| 4,036,372 | 7/1977 | Rao et al. | 212/55 X |

*Primary Examiner*—Robert G. Sheridan
*Attorney, Agent, or Firm*—Walter Becker

[57] ABSTRACT

A telescopic boom, for portable cranes, having one or more hydraulically operated telescopic slides, and one or more mechanically operated telescopic slides. The extension or retraction of the mechanically operated telescopic slide is effected by means of a detachable retaining rod, one end of which is connected with the non-telescopic main boom by means of a bolt inserted transversely therethrough. The other free end of the retaining rod is provided with a pressure piece, for maintaining the boom in some of its positions during extension thereof, and a tensioning device, which is located 180° opposite from the pressure piece, for maintaining the boom in some of its positions during retraction thereof. A plurality of slots are arranged along the mechanically operated telescopic slide transverse to the direction of operation. These slots respectively cooperate with a cam of the pressure piece or with a stop cam of a pawl during extension and retraction of the telescopic slide.

4 Claims, 14 Drawing Figures

15
15a
15b
15c
13
13c
13d
11
8
8a
7
7a
6
5
31
2

TELESCOPIC BOOM FOR PORTABLE CRANES

The present invention relates to a telescopic boom, for portable cranes, having one or more hydraulically operated telescopic slides, and one or more mechanically operated telescopic slides. The extension or retraction of the mechanically operated telescopic slide is effected by means of a detachable retaining rod, one end of which is connected with the non-telescopic main boom by means of a bolt inserted transversely therethrough. The other free end of the retaining rod is provided with a pressure piece, for maintaining the boom in some of its positions during extension thereof, and a tensioning device, which is located 180° opposite from the pressure piece, for maintaining the boom in some of its positions during retraction thereof.

A telescopic boom of the above mentioned type is known from U.S. Pat. No. 4,057,942. According to this patent, the mechanically operated telescopic slide is provided with dovetailed cams which are arranged transverse to the direction of operation. The retaining rod, on one end, is provided with a bolt which is inserted transversely therethrough, and on the other end is provided with a pressure piece and a tensioning piece, the shape of which conforms to the cam. The pressure piece and the tensioning piece are offset from one another by 180°. The above mentioned dovetailed supports are expensive to manufacture. In addition, the mounting of the supports, which serve to receive the retaining rod, to the first telescopic slide hinders a quick extension.

It is therefore an object of the present invention to simplify and accelerate the extension of the telescopic slide and to achieve a cheaper manufacture of the parts necessary therefor.

This object and other objects and advantages of the present invention will appear more clearly from the following specification in connection with the accompanying drawings, in which.

The telescopic boom of the present invention is characterized primarily in that a plurality of slots are arranged along the mechanically operated telescopic slide transverse to the direction of operation. These slots respectively cooperate with a cam of the pressure piece or with a stop cam of a pawl during extension and retraction of the telescopic slide.

The present invention is further characterized in that the pressure piece is detachably connected with the free end of the retaining rod, and a pawl of the tensioning device is mounted in brackets and is rotatably arranged about a bolt on the free end of the retaining rod. The release of the pawl out of the engaging positions of the slots of the telescopic slide to be extended is effected by means of a stop which is adjustably mounted on the free forward end of the succeeding telescopic slide.

Figure 3:
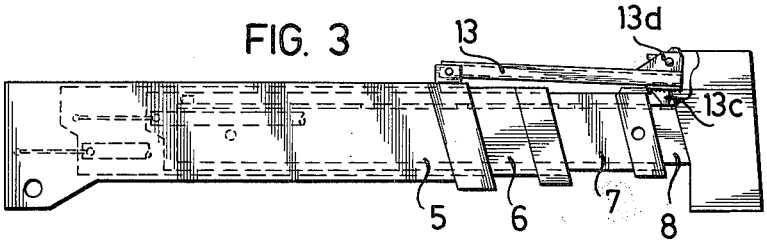
FIG. 3 shows the hydraulic extension of the telescopic slide and the installation of the retaining rod for securely holding the mechanically operated telescopic slide, the hydraulically operated slide being pulled back.
Figures 10, 11, 12:
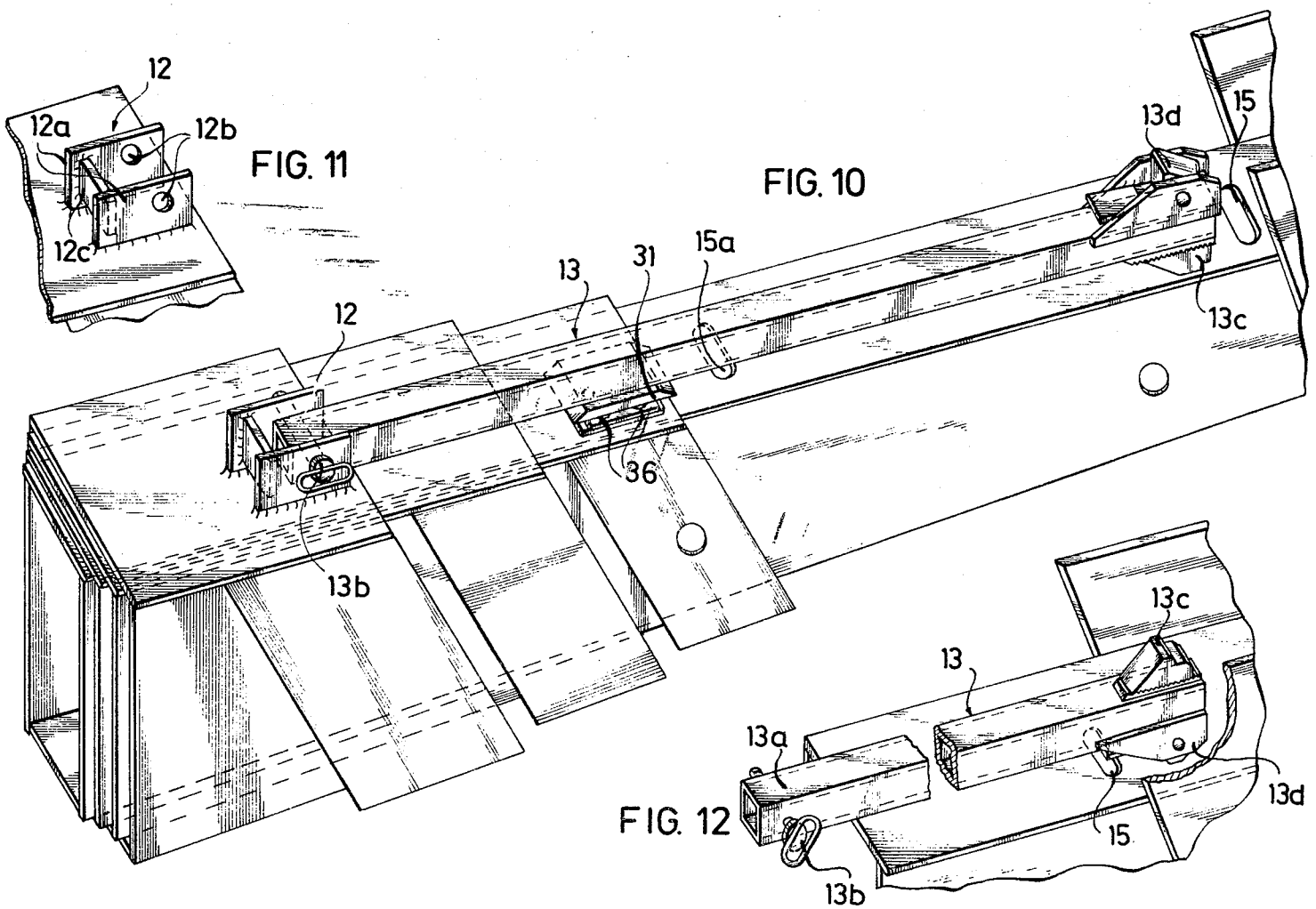
FIG. 10 shows the boom with installed retaining rod for extending the mechanically operated telescopic slide.
FIG. 11 shows the support for receiving the retaining rod.
FIG. 12 shows the retaining rod turned by 180° for retracting the mechanically operated telescopic slide.
Figure 13:
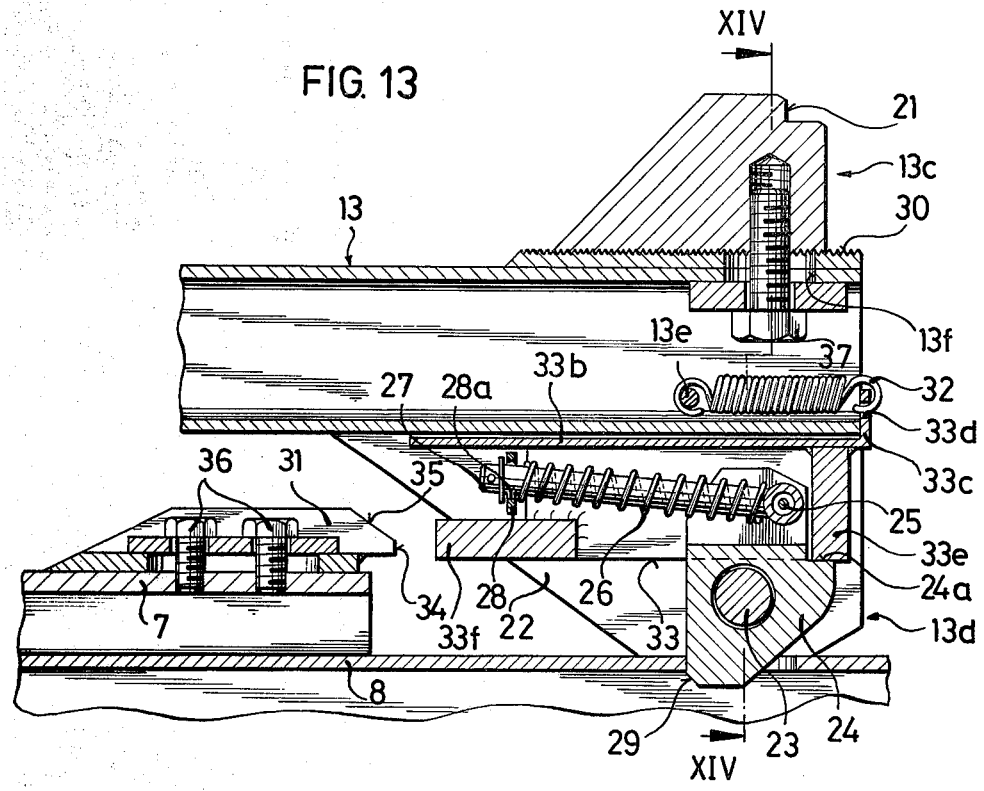
FIG. 13 is a longitudinal section of the tensioning device and pressure piece.
Figure 14:
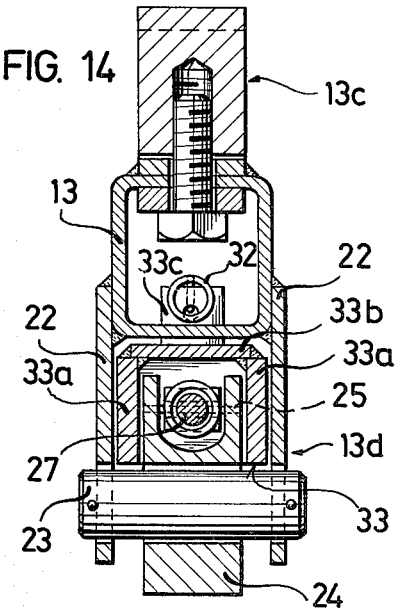
FIG. 14 is a section through the tensioning device and pressure piece of FIG. 13 along the line XIV—XIV thereof.

Referring now to the drawings in detail, the telescopic boom 4 is pivotally arranged on a lower carriage 1, about a pivot bearing 2, in the longitudinal direction of the crane vehicle, which is made portable by rubber-tired wheels 3. The telescopic boom 4 comprises a main boom 5 and the telescopic slides 6, 7 and 8. The telescopic boom 4, by means of the hydraulic cylinder 9, is pivoted about the pivot bearing 2 out of the substantially horizontal position, which it occupies during transport or in non-operating position, into the maximum raised position. The telescopic slide 6 is actuated for extension and retraction by means of the hydraulic cylinder 10 fixedly mounted in the main toom 5. The telescopic slide 7, by means of the hydraulic cylinder **10*a*, is movably connected with the telescopic slide 6. The hydraulically operated telescopic slide 7 and the mechanically operated telescopic slide 8 are bolted together by means of a bolt 11. A support 12 is firmly attached to the main boom 5. The support 12 serves to receive the retaining rod 13 (FIGS. 3, 10 and 12) for extending or retracting the telescopic slide 8. The support 12 (FIG. 11) comprises two metal plates 12*a* which are welded to the main boom 5. The plates 12*a* are provided with bores 12*b* and are interconnected by means of the crosspiece 12*c*. The retaining rod 13, which cooperates with the support 12, comprises a casement or box pipe 13*a*; a bolt 13*b* which is inserted transversely through the hollow retaining rod 13 and is detachably connected therewith; a pressure piece 13*c* which is screwed onto the retaining rod 13; and a tensioning device 13*d* which is similarly attached to the retaining rod 13. Slots 15, 15*a*, 15*b* and 15*c* are arranged on the upper side of the mechanically operated telescopic slide 8 transverse to the direction of extension. The edges of the slots 15–15*c* serve as stops or supports for the retaining rod 13. The pressure piece 13*c* or tensioning device 13*d* engages the slots 15–15*c***.

A partially disengageable tensioning device **13*d* is attached to the free end of the retaining rod 13. The tensioning device 13*d* effects the engagement of the retaining rod 13 into the slots 15–15*c*. The pressure piece 13*c* is screwed onto the free end of the retaining rod 13 and is provided with a cam 21, by means of which the retaining rod 13 engages one of the slots 15–15*c*. After loosening the hexagon head screw 37, the pressure piece 13c, by means of the grooving 30 located on the retaining rod 13, can be moved by the length of the slot 13f and thereby positioned. Two brackets 22, located 180° from one another, are welded onto the free end of the retaining rod 13. A pawl 24, which is pivotal about bolt 23, is mounted in the brackets 22. One end of pawl 24 is provided with a pin 25, which forms the support for a compression spring 26. The bolt 27 serves as a guide for the compression spring 26 and is itself guided in the opening 28a of the washer 28, which is welded on between the brackets 22. The guide 33 essentially comprises side plates 33a which are welded in the form of a U to the cover plate 33b on which is welded the flange 33c which forms a right angle with the cover plate 33b. In the flange 33c is a bore 33d in which one end of the tension spring 32 is suspended. The other end of the tension spring 33 is suspended on a bolt 13e which is inserted through the retaining rod 13 as support. The stop 33e, which is welded onto the free end of the cover plate 33b, engages a recess 24a of the pawl 24. The stop 33f is welded on between the side plates 33a. The other end of the pawl 24 is formed as a lug or stop cam 29 which engages one of the slots 15–15c when the retaining rod 13 operates as a pull rod. The retaining rod 13 is inserted in the support 12. The stop cam 29 of the pawl 24, which is rotatably mounted on the retaining rod 13, successively catches or engages the slots 15c, 15b, 15a and 15 of the telescopic slide 8. After that, by extending the telescopic slides 6 and 7, the telescopic slide 8 is pushed into the telescopic slide 7. The releasing of the stop cam 29 of the pawl 24 from the slots 15c–15 of the telescopic slide 8 is effected by means of the stop 31, which is adjustably attached to the telescopic slide 7 with screws 36. The stop 31, after a partial stroke has been effected, is pushed against or abuts the stop 33f of the guide means 33 with its stop face 34, displacing the guide means 33. As a result, the pawl 24 disengages and the brackets 22 slide up along that inclined surface 35 of the stop 31 which faces the stop 31. The lug or stop cam 29, during hydraulic retraction of the telescopic slides 6 and 7, then glides over the upper plate of the telescopic slide 8, which is carried along by friction, until the stop cam 29 engages the next slot, so that during the extension and subsequent retraction of the hydraulic telescopic slides 6 and 7 which then follows, the telescopic slide 8 is retracted still further. This operation is repeated until the telescopic slide 8** is completely retracted.

Figure 1:
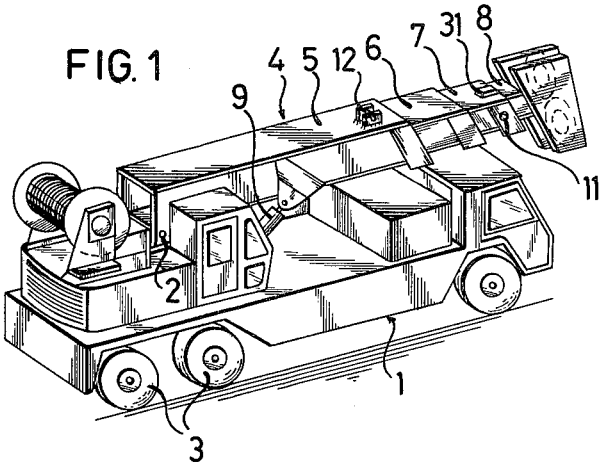
FIG. 1 is a crane vehicle with a telescopic boom.
Figure 2:
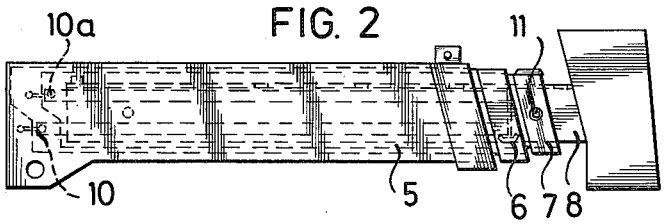
FIG. 2 is a side view of a completely retracted telescopic boom.
Figure 4:
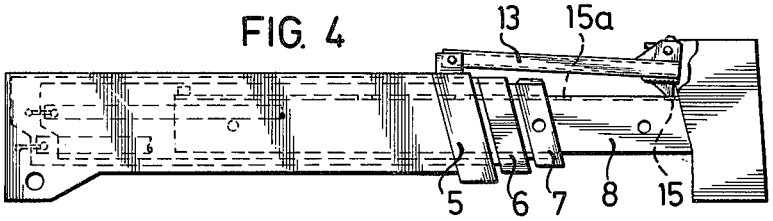
FIG. 4 shows the retracted hydraulically operated telescopic slide and the first extension stage of the mechanically operated slide.
Figure 5:
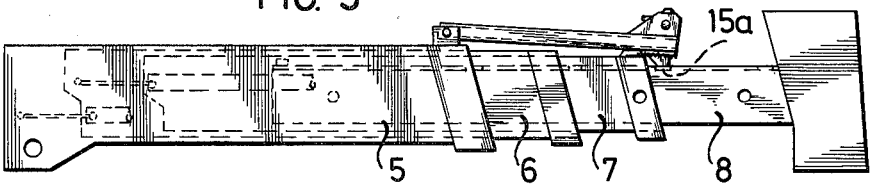
FIG. 5 shows the second extension stage of the mechanically operated telescopic slide.
Figures 6, 7, 8, 9:
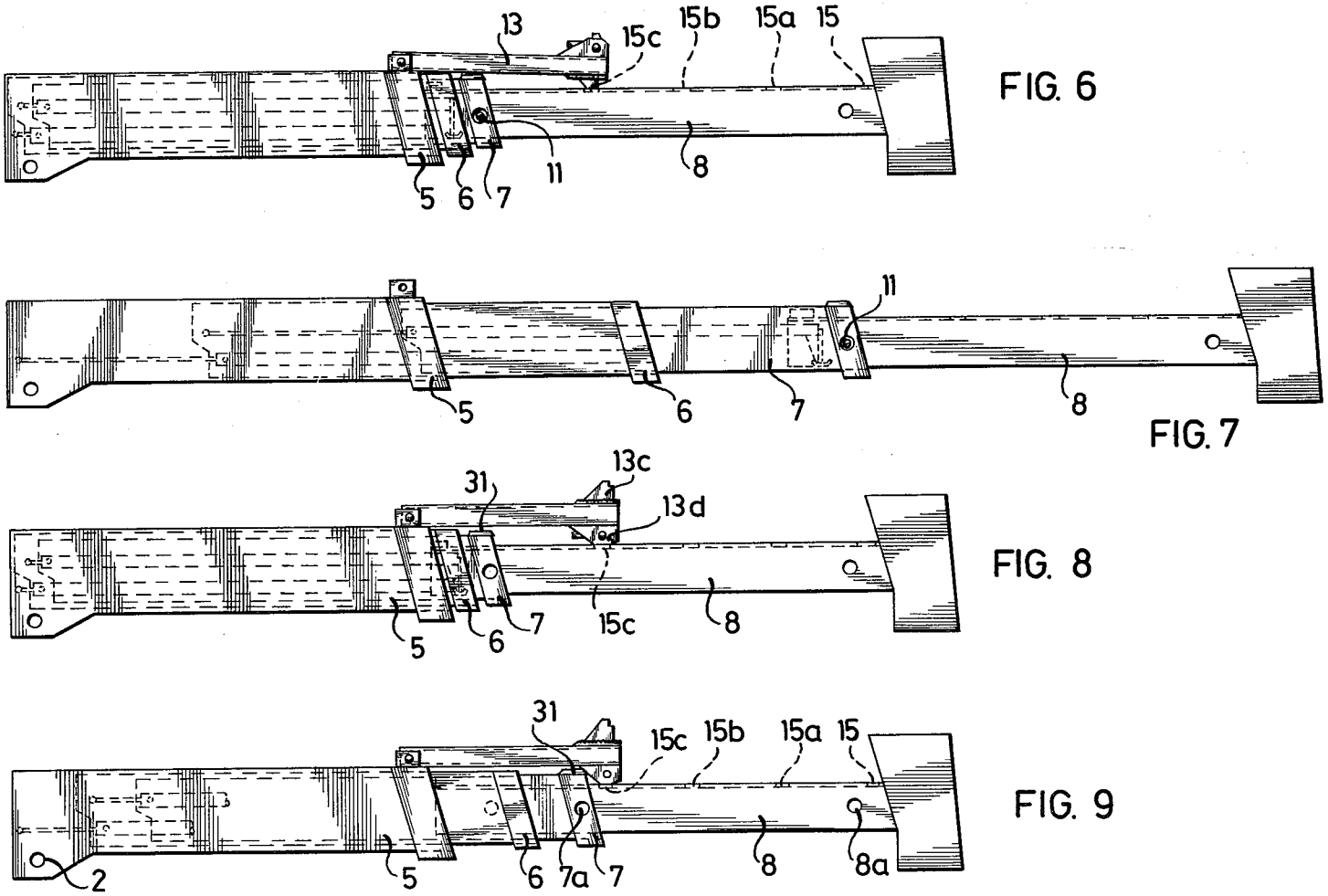
FIG. 6 shows the completely extended mechanically operated telescopic slide.
FIG. 7 shows the two hydraulically operated telescopic slides partially extended and the mechanically operated telescopic slide completely extended.
FIG. 8 shows the installation of the retaining rod to make it possible to retract the completely extended mechanically operated telescopic slide.
FIG. 9 shows the extended hydraulically operated telescopic slide and the first retraction stage of the mechanically operated telescopic slide.

The mode of operation is as follows: in the retracted state of the telescopic boom 4, the mechanically operated telescopic slide 8, by means of the bolt 11, is fixedly connected with the hydraulically operated telescopic slide 7 (FIG. 2). By actuation with oil under pressure, the telescopic slide 7 is extended far enough that the retaining rod 13, with the bolt 13b, engages the bore 12b of the support 12 and, with the other end, by means of the pressure piece 13c, the retaining rod 13 engages the first slot 15. The bolt 11 is then removed. After that, the telescopic slides 6 and 7 are hydraulically retracted. The mechanically operated telescopic slide 8 remains extended and places the next slot 15a into operating position (FIG. 4). By repeating the above described procedure, namely the hydraulic extension of the telescopic slides 6 and 7 until the cam 21 of the retaining rod 13 engages the slot 15a of the telescopic slide 8, and the subsequent hydraulic retraction of the telescopic slides 6 and 7 by means of the hydraulic cylinder 10 and 10a (FIG. 5), the mechanically operated telescopic slide 8 is extended still further. After by means of further steps, as described above, the telescopic slide 8 reaches the end position, the telescopic slides 7 and 8 are interconnected by means of the bolt 11 (FIG. 6). After moving the retaining rod 13 and hydraulically actuating the telescopic slides 6 and 7, the maximum extension of the telescopic boom 4 is finally achieved (FIG. 7). The retraction of the mechanically operated telescopic slide 8 is effected by reversing the above described process. For this purpose, the retaining rod 13 is turned by 180° so that the stop cam 29 of the pawl 24 first engages the slot 15c (FIGS. 8 and 9). The stop cam 29 of the pawl 24, by successively actuating the hydraulic cylinders 10 and 10a, then successively engage the slots 15c, 15b, 15a and 15, until the bore 7a of the telescopic slide 7 is aligned with the bore 8a of the telescopic slide 8 and the bolt 11 can be inserted therethrough, so that the telescopic slides 7 and 8 are fixedly interconnected. The stop cam 29 of the pawl 24, in this phase, engages the slot 15. Although only one mechanically operated telescopic slide is shown, additional mechanically operated telescopic slides could be provided to lengthen the boom by connecting them, by means of detachable bolts, to the mechanically operated telescopic slide shown in the drawings. Similarly, one of the hydraulically operated telescopic slides shown in the drawings could be omitted, or additional hydraulically operated telescopic slides could be added. The length of the retaining rod may, of course, have to be changed in order that the pressure piece and tensioning piece can engage the proper slots.

It is, of course, to be understood that the present invention is by no means limited to the specific showing of the drawings, but also encompasses any modifications within the scope of the appended claims.

What we claim is:

1. A telescopic boom, for portable cranes, which comprises:

a main boom;

at least one hydraulically operated telescopic slide telescopically associated with said main boom;

at least one mechanically operated telescopic slide telescopically associated with said at least one hydraulically operated telescopic slide and said main boom, said at least one hydraulically operated telescopic slide and said at least one mechanically operated telescopic slide being adapted to be respectively extended from and retracted into said main boom, slots being provided along said at least one mechanically operated telescopic slide transverse to the direction of extension and retraction thereof;

a retaining rod, one end of which is detachably connectable to said main boom;

a pressure piece detachably connectable to a portion of the other end of said retaining rod;

a cam associated with said pressure piece for cooperation with said slots during extension of said at least one mechanically operated telescopic slide;

a tensioning piece detachably connectable to a portion of said other end of said retaining rod 180° from said pressure piece;

a pawl associated with said tensioning piece; and a stop cam associated with said pawl for cooperation with said slots during retraction of said at least one mechanically operated telescopic slide.

2. A telescopic boom according to claim 1, which includes:

a bracket associated with said tensioning piece and connected to said retaining rod at the same end of, and 180° from, said pressure piece, said pawl being rotatably mounted in said bracket; and a first stop adjustably mounted on that end of the at least one hydraulically operated telescopic slide closest to said mechanically operated telescopic slide which is most remote from said main boom, said first stop being operable to release said stop cam of said pawl from one of said slots.

3. A telescopic boom according to claim 1, which includes:

guide means associated with said tensioning piece;

a second stop connected to said guide means for engaging said pawl; and a tension spring, one end of which is suspended on said guide means, the other end of which is suspended on said retaining rod.

4. A telescopic boom according to claim 1, in which the contact surfaces between said pressure piece and said retaining rod are correspondingly grooved so as to allow adjustment of the position of said pressure piece relative to said retaining rod.

* * * * *